US011291899B1

(12) United States Patent
Smith

(10) Patent No.: US 11,291,899 B1
(45) Date of Patent: Apr. 5, 2022

(54) FEEDBACK-BASED SWING TRAINER

(71) Applicant: Country Innovation and Supply, LLC, Winder, GA (US)

(72) Inventor: Keaton Smith, Winder, GA (US)

(73) Assignee: County Innovation and Supply, LLC, Winder, GA (US)

( * ) Notice: Subject to any disclaimer, the term of this patent is extended or adjusted under 35 U.S.C. 154(b) by 39 days.

(21) Appl. No.: 17/062,664

(22) Filed: Oct. 5, 2020

(51) Int. Cl.
*A63B 69/36* (2006.01)
*A63B 69/00* (2006.01)
*A63B 69/38* (2006.01)

(52) U.S. Cl.
CPC ..... *A63B 69/0079* (2013.01); *A63B 69/0002* (2013.01); *A63B 69/3623* (2013.01); *A63B 69/38* (2013.01); *A63B 2069/0008* (2013.01)

(58) Field of Classification Search
CPC . A63B 69/0079; A63B 69/38; A63B 69/3623; A63B 69/0002; A63B 2069/0008
USPC ..... 473/139, 142, 143, 145, 148, 415–417, 473/423–424, 427, 430, 429, 481, 482
See application file for complete search history.

(56) References Cited

U.S. PATENT DOCUMENTS 2,060,946 A * 11/1936 Severyn ..... B64C 39/00 244/45 R
2,976,040 A * 3/1961 Bales ..... A63B 69/0079 473/429
4,105,203 A * 8/1978 Cho ..... A63B 69/0091 473/429
4,145,054 A 3/1979 Stewart
4,932,660 A * 6/1990 Wang ..... A63B 69/0079 473/143
5,244,392 A * 9/1993 Maursetter ..... A63B 69/0079 473/429
5,421,579 A 6/1995 Ubele, Jr.
5,427,369 A * 6/1995 Baquet, Jr. ..... A63B 69/0091 473/429
5,454,561 A 10/1995 Smith
5,480,141 A * 1/1996 Wood ..... A63B 69/0079 473/140
5,577,964 A * 11/1996 Chen ..... A63B 69/0091 473/145
5,911,635 A 6/1999 Ogden
(Continued)

OTHER PUBLICATIONS

Schutt Sports Hit Zone Swing Trainer, https://www.schuttsports.com/hit-zone-swing-trainer.html.
(Continued)

*Primary Examiner* — Nini F Legesse
(74) *Attorney, Agent, or Firm* — Patricia C. Brzostowicz; Superior Patent Group, LLC

(57) ABSTRACT

A swing training device for baseball, softball, golf players, and potentially racquet sports players that provides feedback as to where the ball is hit. The swing training device comprises a first vertical member rigid and columnar in form connecting to a first horizontal member, being rod-like in form, at a first end. A second end of the first horizontal member comprises a ball-shaped end connecting with a swivel joint to a second vertical member. The swivel ball joint connection allows the second vertical member to rotate at an angle such that the player knows whether their hit contacted the ball in the center, or to the left or right of center, thereby allowing the player to make adjustments in their swing based on angle of rotation of the ball around the first horizontal member.

5 Claims, 9 Drawing Sheets

(56) References Cited

U.S. PATENT DOCUMENTS

| | | | | |
|---|---|---|---|---|
| 6,129,637 | A * | 10/2000 | Wang | A63B 69/3655 473/145 |
| 6,290,618 | B1 * | 9/2001 | Ring | A63B 69/0002 473/422 |
| 6,530,845 | B1 | 3/2003 | Corbett | |
| 6,579,189 | B2 * | 6/2003 | Anzaldua | A63B 69/0079 473/139 |
| 6,783,464 | B1 | 8/2004 | Romano | |
| 7,048,638 | B2 | 5/2006 | Novotny | |
| 7,131,916 | B2 | 11/2006 | Griffin | |
| 7,134,968 | B1 | 11/2006 | Pryor | |
| 7,198,579 | B2 | 4/2007 | Moss et al. | |
| 7,874,930 | B2 | 1/2011 | Hubley | |
| 7,955,196 | B2 | 6/2011 | Constant | |
| 8,033,934 | B1 | 10/2011 | Clancy | |
| 8,500,569 | B2 | 8/2013 | Moore | |
| 8,585,516 | B1 | 11/2013 | Buono et al. | |
| 8,784,240 | B1 | 7/2014 | Buono et al. | |
| 8,900,075 | B2 | 12/2014 | Gu | |
| 9,011,277 | B2 * | 4/2015 | Schell | A63B 69/002 473/429 |
| 2005/0003908 | A1 | 1/2005 | Smull et al. | |
| 2007/0178986 | A1 | 8/2007 | Leadbetter et al. | |
| 2016/0144258 | A1 * | 5/2016 | Stephens | A63B 69/36212 473/229 |

OTHER PUBLICATIONS

Slugmaster trainer, http://www.slugmaster.com/.
BackSpin Tee, https://www.backspintee.com/.

* cited by examiner

FEEDBACK-BASED SWING TRAINER

FIELD

This disclosure relates to the field of swing practice aids. In more specific terms the disclosure is drawn to a device for swing accuracy for baseball hitters, golf players, and potentially other sports including but not limited to tennis and racquetball.

BACKGROUND

Several devices have been developed for increasing skill of baseball and softball players particularly for swinging and/or batting skill. These devices such as those described in U.S. Pat. No. 2,976,040 to Bales, U.S. Pat. No. 7,198,579 to Moss et al., U.S. Pat. No. 9,955,196 to Constant, U.S. Pat. No. 8,033,934 to Clancy, U.S. Pat. Nos. 8,585,516 and 8,784,240 to Buono et al, U.S. Pat. No. 8,900,075 to Gu, and U.S. Patent Application Publication No. 2005/003908 by Smull et al. generally comprise a vertical member and horizontal member with ball hanging from the end of the horizontal member to position the ball for hitting by the hitter removing the need for a pitcher, thereby allowing a hitter to practice alone.

Golf swing training aids vary in type, some being aids attached to the club as in U.S. Pat. No. 4,145,054 to Stewart, U.S. Pat. No. 5,911,635 to Ogden, and U.S. App. No. 2007/0178986 to Leadbetter et al. Other designs such as that of Romano in U.S. Pat. No. 6,783,464, U.S. Pat. No. 8,500,569 to Moore, and U.S. Pat. No. 7,134,968 to Pryor attach to the golf player. Others such as U.S. Pat. No. 6,530,845 to Corbett and U.S. Pat. No. 7,874,930 to Hubley are attached to the golf ball. One described in U.S. Pat. No. 7,048,638 to Novotny comprises a resistance system anchored to a golf club.

Where the ball is hit by the bat or club is very important and determines how far and in which direction the ball will travel. Did the player hit the ball in the middle where the swing will have the best effect, transfer the most power such that the ball will travel the farthest possible? Did the player hit the ball on the inside? Or the outside? Hitting the ball on the outside or inside could send the ball in an errant direction, or even cause it to fly out of bounds. With these above mentioned devices there is no way to evaluate where the player hit the ball and if the swing and contact with the ball would produce a well hit ball. The prior art devices do not provide feedback to the player as to whether the hitter is hitting the ball correctly.

SUMMARY

It is one objective of the present disclosure to provide a device for improving a swing of a player, being a baseball and/or golf player and potentially other sports that involve hitting a ball such as tennis and/or racquetball.

It is an objective of the present disclosure to provide a device that gives immediate feedback to the player as to how the ball was hit such that the player may adjust their approach to hitting the ball.

It is an objective of the present disclosure to provide a swing training device that is portable and stable with options for supporting the swing training device of the present disclosure whether via a base or via attachment to a trailer hitch of a vehicle.

It is an object of the present disclosure to provide a method for improving swing of a hitter whether a baseball hitter, golf player, or other athlete aiming to improve hitting skills.

As such the swing trainer may comprise: a first vertical member being rigid and columnar in form; a first horizontal member being rod-like in form and having two ends, the first end connected to the first vertical member and the second end being a rounded ball-shaped end; a second vertical member with a rigid upper rod-like portion connecting to a circular-shaped opening, wherein the circular-shaped opening fits onto the rounded ball-shaped end of the first horizontal member thereby allowing the second vertical member to rotate around the first horizontal member at an angle up to about twenty five degrees towards and away from the first vertical member; and a sports ball connected to a lower end of the second vertical member.

Further, the swing trainer may comprise a second horizontal member being rigid in form and having a first and second end, wherein the first end is connected to a bottom end of the first vertical member. The second horizontal member may be shaped to connect to a hitch receiver of a vehicle. The swing trainer may further comprise an opening on the second horizontal member, the opening designed to receive a pin therethrough and to align with an opening in the hitch receiver. The swing trainer may further comprise three rigid angled members attached to the second horizontal member. The swing trainer may further comprise a rigid angled member attached to the first vertical member. The three rigid angled members may be attached to the second horizontal member near the first end and the third angled member is attached to the second horizontal member near the second end. Inasmuch, the first horizontal member of the swing trainer may be connected to the first vertical member near a top end of the first vertical member or the first horizontal member may be connected to the first vertical member near a bottom end of the first vertical member. The swing trainer may further comprise a base.

In another form, the trainer may comprise a first vertical member being rigid and columnar in form; a first horizontal member being rod-like in form and having a first and second end, the first end connected to the first vertical member the second end being a rounded ball-shaped end; a second vertical member with a rod-like rigid upper portion connecting to a circularly-shaped opening, wherein the circularly-shaped opening fits onto the rounded ball-shaped second end of the first horizontal member thereby allowing the second vertical member to rotate around the rigid first horizontal member at an angle up to about twenty five degrees towards and away from the rigid first vertical member; a rigid second horizontal member connected to a top portion of the first vertical member having three angular members attached thereto two being connected on opposite sides at an end connecting to the first vertical member, and one being connected at an end opposite to the end connecting to the first vertical member; and a sports ball connected to a lower end of the second vertical member.

The disclosure further comprises a method for improving the swing of a player, the method comprising: providing first vertical member columnar and rigid in form; providing a first horizontal member rod-like in form with a first end attached to the first vertical member and a second end being a ball-shaped structure; providing a second vertical member attached at a first end with a swivel joint to the second ball-shaped end of the first horizontal member, wherein the swivel joint allows the second vertical member to rotate around the first horizontal member and angle up to about twenty-five degrees towards and away from the first vertical member; providing a base to hold the first vertical member upright; providing a sports ball at a second end of the second vertical member; and striking of the ball by the player.

The method may further comprise providing feedback to the player, the feedback comprising determining location of bat impact with ball by angle the ball spins around the first horizontal member. The feedback from hitting the ball in the center comprises that the ball spins in a plane angled about zero degrees with respect to the first vertical member. The feedback from hitting the ball on the inside by a right-handed hitter, or conversely on the outside by a left-handed hitter, comprises that the ball spins in a spherical plane of at most twenty-five degrees away from the plane of the first vertical bar. The feedback from hitting the ball on the inside by a right-handed hitter, or conversely on the outside by a left-handed hitter, comprises that the ball spins in a spherical plane of at most twenty-five degrees towards the plane of the first vertical bar.

In another embodiment the disclosed is a swing trainer, wherein the swing trainer comprises: a first vertical member being rigid and columnar in form; a first horizontal member being rod-like in form and connected at a first end to a top end of the first vertical member and having a second ball-shaped end; a second vertical member having a rigid first end connected to the second ball-shaped end of the first horizontal member; a swivel joint connecting the rigid first end of the second vertical member to the second ball-shaped end of the first horizontal member, wherein the swivel joint connection with the ball-shaped end allows the second vertical member to angle up to about twenty five degrees towards and away from the first vertical member; and a sports ball connected at a second end of the second vertical member. This embodiment may further comprise a rigid second horizontal member connected to a bottom end of the first vertical member. The swing trainer of this embodiment may further comprise a base. The swing trainer of this embodiment may comprise a second end of the first vertical member connected to a rope spanning from the first rigid end to the second end. Further articles and embodiments are described in more detail below.

Figure 1:
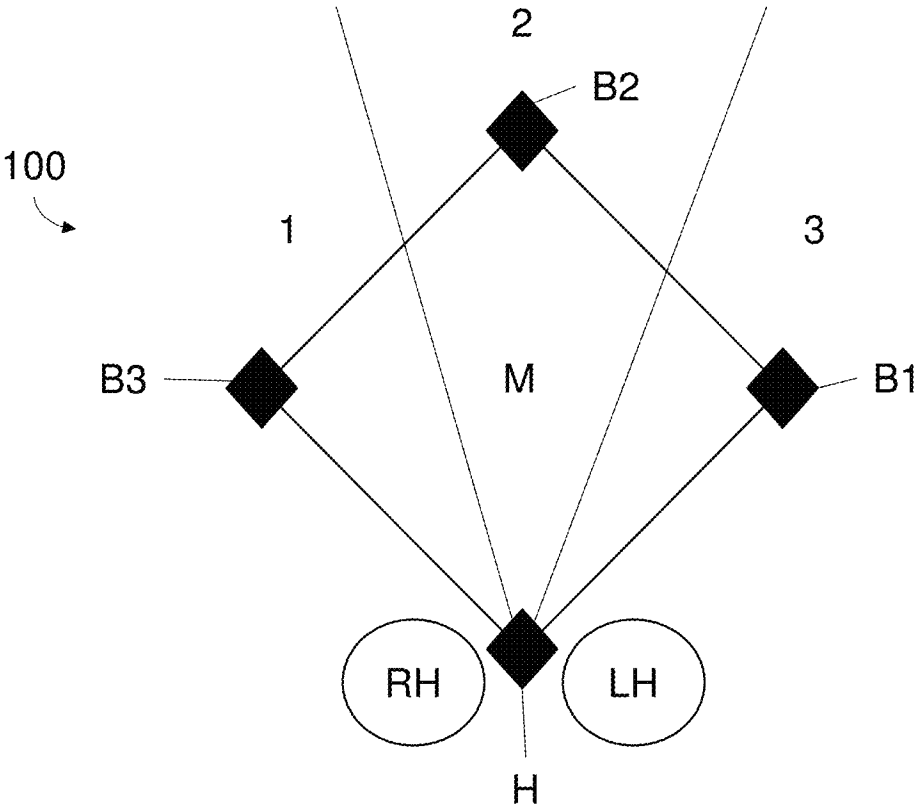
FIG. 1 is a schematic illustration of a baseball or softball field.

Before explaining the disclosed embodiments of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION

In the following description several terms are to be noted. A hitter or player is a person using a baseball or softball bat, or golf club, or perhaps in other embodiments a racquet, such as a tennis racquet or racquet ball racquet to hit a ball being a sports-type ball. Bats, clubs, and racquets may be of many varieties. Bat varieties may include being one piece, two piece, or more, and made of wood, alloy, which is aluminum mixed with other metals, aluminum, composite bats, being made of plastic, graphite, titanium or other composites, hybrid bats, usually with a spine of aluminum and a barrel made of titanium, graphite, and/or plastic, wood bats being of several varieties including but not limited to maple, hickory, bamboo, ash, or birch. Bats may be various lengths, sizes, and designs for varying sized players and needs. In general bats are long spherical rod-shaped structures being narrower at one end for gripping with hands, the end of device called a handle of the bat, and with a barrel that forms the end of the bat designed to make contact with a ball.

Golf clubs come in several varieties including woods, having the largest heads, being typically hollow, and with the longest shafts, and are used for longest shots. Irons generally come in numbered sets usually ranging from three to nine and have smaller club heads than woods, with most being solid and are used for shots from the fairway or for tee shots. Hybrid clubs are a cross between a wood and an iron. Wedges have the same club head as irons but are more severely angled and used for shorter approach for chips and pitches. Putters are most specialized and used for putting short shots into the hole. Tennis and racquetball rackets may come in a variety of shapes and sizes to fit the user. Generally racquetball rackets have shorter handles.

A sports ball in the present disclosure may be a baseball or softball sized ball, golf, tennis, racquet ball sized ball being a spherical device that may be fashioned from man-made, being synthetic, or natural materials. Regulation baseballs are nine to 9.0 to 9.25 inches in circumference with weigh 5 to 5.25 ounces. A softball is generally larger than a baseball being about eleven to sixteen inches in circumference. A golf ball is approximately 1.680 inches in diameter with "conforming" golf balls for United States Golf Association being not smaller than 1.680 inches in diameter with a weight of 1.62 ounces. A tennis ball may be approximately 2.575 inches in diameter with the definition of a regulation tennis ball by the International Tennis Federation being a diameter of at least 2.575 inches and not more than 2.700 inches. A tennis ball will weigh approximately 56.0-59.4 grams. A racquetball is generally about 2.25 inches in diameter and about 1.4 ounces or 40 grams.

As shown in FIG. 1 a baseball and/or softball field or diamond 100 consists of four bases, home H, first B1, second B2, and third B3. A player being a batter or a hitter may hit right-handed RH or left-handed LH. When a hitter hits with his/her right hand the hitter will stand on the left side of home base H, when viewed from behind. Home base H defines the area the sports ball is thrown or pitched over by a player called a pitcher who stands approximately in the center of the diamond on a mound M and throws a sports ball towards home plate H. In the game of baseball or softball, the hitter RH, LH will try to hit the sports ball and run to at least first base B1 before another player catches the sports ball and either tags the hitter RH, LH or a player touching first base B1 catches the sports ball.

A sports ball hit with the bat or in the center of the sports ball will go further and faster than those hit on the side of the sports ball. A sports ball hit on the inside by a right-handed hitter RH, the inside being the side of the sports ball closer to the hitter RH, will travel to the left into zone 1 shown on the field 100 in FIG. 1. A sports ball hit on the inside by a left-handed hitter LH will travel into zone 3. A sports ball hit in the center by a right-handed RH or left-handed hitter LH will generally travel straight out from the hitter into a zone 2 shown in FIG. 1. A sports ball hit on the outside, the side away from the hitter, by a right-handed hitter RH will travel into zone 3 on the field 100. Conversely, a sports ball hit on the outside by a left-handed hitter LH will travel into zone 1 on the field 100. Where the sports ball is hit by the hitter RH, LH determines how fast and far and where the ball will travel as well as direction of travel, therefore it is very important for the hitter RH, LH to be able to hit the sports ball in the desired place to make it go in the desired direction. Whereas prior art devices enable a hitter to practice hitting a sports ball over and over without the need for a pitcher, they do not provide information or feedback as to whether the ball is hit inside, outside, or on the center. The present device and method disclosed are a feedback-based baseball and softball swing trainer designed to provide critical feedback at the time the sports ball is hit. With the disclosed device and method the hitter RH, LH may adjust the swing to hit the sports ball in the correct place and through repetition develop the muscle memory critical to performing the act correctly again and again.

Figure 2:
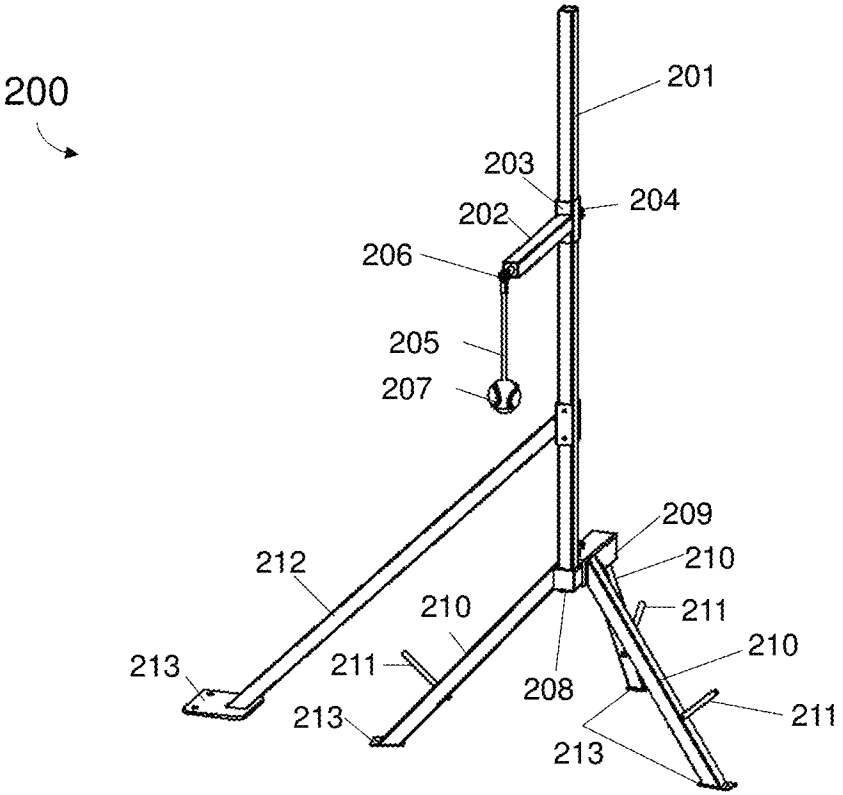
FIG. 2 illustrates one embodiment of the swing trainer of the present disclosure.

FIG. 2 illustrates one embodiment of the swing trainer 200 of the present disclosure. The swing trainer 200 comprises a first vertical member 201 being rigid and columnar in form and positioned about ninety-degrees from the ground. A first horizontal member 202, also generally rigid and rod-like in shape and structure, is semi-permanently attached via a connector sleeve 203 and a screw pin 204 to the first vertical member 201. The first vertical member 201 may be approximately at least one foot in length, or two feet in length, or at least three feet, or at least four feet, or at least five feet, or at least six feet in length or height or more. The first horizontal member 202 may be attached at various locations or heights on the first vertical member 201 depending on need or preference which may depend on the height of a hitter RH, LH. The first horizontal member 202 may be approximately at least one foot in length, or at least two feet in length, or at least three feet in length to allow for rotation of the sports ball 207.

Figure 3B:
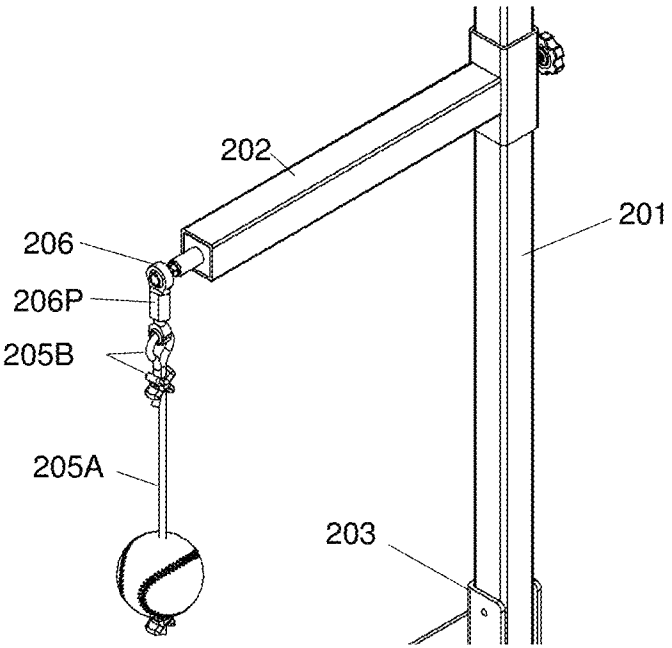
FIG. 3B illustrates in a close-up view of one aspect of the swing trainer of the present disclosure being the second vertical member.
Figure 3A:
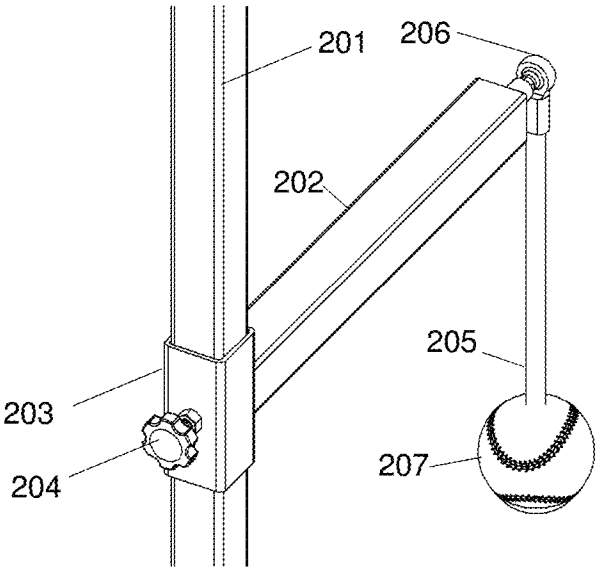
FIG. 3A illustrates in a close up view one aspect of the swing trainer of the present disclosure being the connection between the first vertical member and first horizontal member.

As shown in FIG. 3A, attachment of the first horizontal member 202 to the first vertical member 201 may be achieved at various heights by many means including as shown here a connector sleeve 202 and screw pin 204 device to provide nearly unlimited height adjustment. When the screw pin 204 is loosened the sleeve can be moved to the correct height and the screw pin 204 tightened against the first vertical member 201 to hold it in place. Other means of height adjustment can be envisioned such as making multiples holes in the first vertical member for screws or pins to fit therein thereby holding the connector sleeve 203 and first horizontal member 202, or just the first horizontal member 202, in place.

The vertical and horizontal members, connector, bolts, and pieces of the trainer of FIG. 2, 200 and other figures disclosed herein may be mostly rigid in nature formed of metal or metal alloys, examples being stainless steel, powder coated stainless steel to prevent weather corrosion or rust, aluminum, or other appropriate metals or composite materials being plastics, ceramics, or carbon. This training device 200 and its individual pieces if made of metal may be formed or fabricated via cutting and welding, folding, machining, punching, shearing, stamping, casting, extrusion or other known methods of manufacture. Carbon and or carbon fiber or carbon reinforced plastic devices are generally made by molding techniques as are plastic devices. The horizontal members may be fashioned of metal with hollow insides to allow for various connections between members. It is envisioned that alternate design materials and design may be appropriate and is encompassed by this application.

As shown in FIG. 2, a second vertical member 205, being rod-like, rectangular or cylindrical in shape, is attached at the free end of the first horizontal member 202. The second vertical member 205 may be approximately at least three inches, or at least six inches in length or height, or at least one foot, or at least eighteen inches, or at least two feet, or at least three feet or more in length. A ball swivel joint 206, form of which is explained in greater detail below, attaches the first horizontal member 202 to the second vertical member 205 at a proximal end. As shown in FIG. 3A the second vertical member 205 may be comprised of one rigid section 205 being metal or metal alloy or appropriate material for manufacture as described above. Alternately, as shown in FIG. 3B, the second vertical member may be comprised of an upper rigid section 206P and a string or rope-like structure 205A that is more flexible than a rigid metal rod 205 of FIG. 3A. As shown in FIG. 3B, a loop connector and/or knot 205B may connect the flexible vertical member 205A to the ball swivel joint 206. Other connections means may be appropriate. The ball swivel joint 206 should have a small portion or end 206P that is rigid such that the angle the sports ball travels in is maintained when it spins around the first horizontal member 202 as will be described in more detail below.

Referring again to FIG. 2, members being the first vertical member 201, first horizontal member 202, second vertical member 205, swivel ball joint 206, sports ball 207, and connections thereof being 203,204 and others, like the connection of the second vertical member 205 to the sports ball which may be via a screw, pin, or knot, some of which are not shown, form the first embodiment of the swing training device. Additional parts may be a base for holding the swing training device upright on the ground and alternate attachments thereof described herein. The length and heights of these and other various members 201, 202, 205, 208, 209, 210, 212 may be of a various ratios as to allow for maximum function of the device. As such the length of the first horizontal member 202 may be at least approximately a fifth, or at least one fourth of the length of the first vertical member 201, or at least one third, or at least one-half or more. The length of the second vertical member 205 may be at least one fifth, or at least one fourth, or at least one third, or at least one half, or three-quarters, or more of the length of the first vertical member 201. The length of the first horizontal member 202 may vary depending on use whether for baseball, softball, tennis or racquetball, or golf. One may envision length of the first horizontal member 202 being longer to account for a tennis and/or other racquet sports. One may envision that the height of the first horizontal member 201 being much shorter when used by a golfer as will be shown in figures below and device height adjustable via horizontal member 202 adjustment means 203, 204 and legs 210 as further explained herein. Generally the first horizontal member may be about twelve inches, or sixteen inches, or about two feet tall/or in length or height, or at least three feet tall, or at least four feet in length/height, or at least five feet, or at east six feet or more.

As shown in FIG. 2, a sports ball 207 is attached to a distal end of the second vertical member 205. The sports ball may be a baseball or softball, a golf ball, tennis ball, racquet ball, or other ball of similar size. The sports ball may be made of natural or man-made materials, and/or coated for weather-resistance. A second horizontal member 208, being generally rectangular in shape is attached to the bottom of the first vertical member 201. In addition to the first vertical member 201, first horizontal member 202, second vertical member 205, ball swivel joint 206, and ball 207, and other connections thereof 203, 204, being the main parts needed for the swing training device, a second horizontal member 208 may be inserted in a horizontal base member 209. The horizontal base member 209 has three legs 210, two being attached near one end, and one being attached near the other end to hold the trainer 200 upright. The horizontal base member 209 and the three legs 210 may be one piece. Alternately, the legs 210 may be removable. The legs 210 may be comprised of at least one piece or alternately comprised of at least two pieces wherein a lower inner piece slides into an upper outer piece to make the length of the legs adjustable. Pins 211 may be fitted through holes in the inner and outer pieces of the legs to hold them at certain lengths. An angular support member 212 may also be attached to the first vertical member 201 for support. The angular support member 212 as well as legs 210 of the base member 209, may have base plates 213 attached at the ends for balance. It is conceived that other arrangements and styles for a base to hold the first vertical member 201, first horizontal member 202, second vertical member 205, ball swivel joint 206, sports ball 207, and connecting parts 203, 204 upright during use may be employed including a flat base or base with various numbers of legs and support members.

Figure 5B:
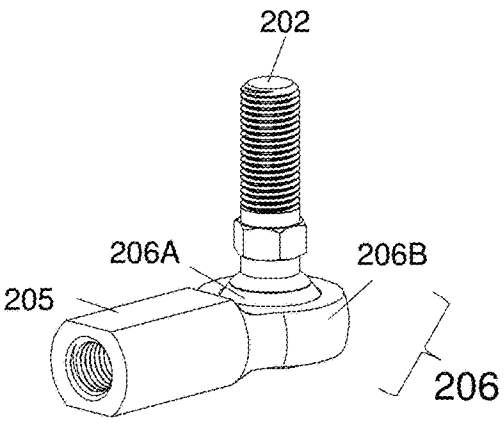
FIG. 5B illustrates a second view of the swing trainer swivel ball joint.
Figure 5A:
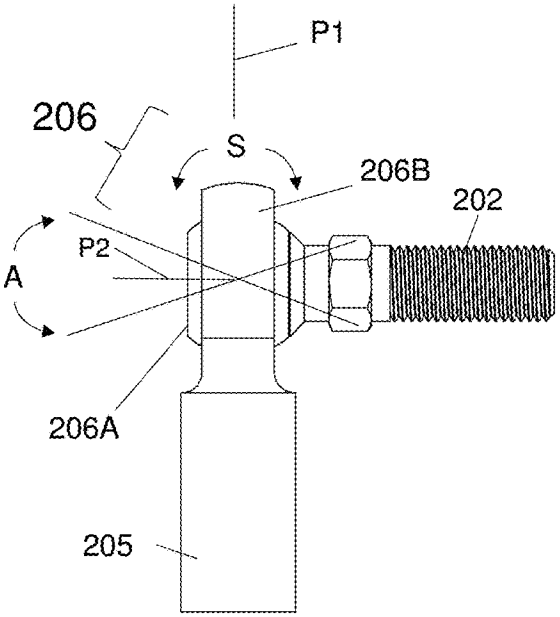
FIG. 5A illustrates the swivel ball joint.
Figure 4:
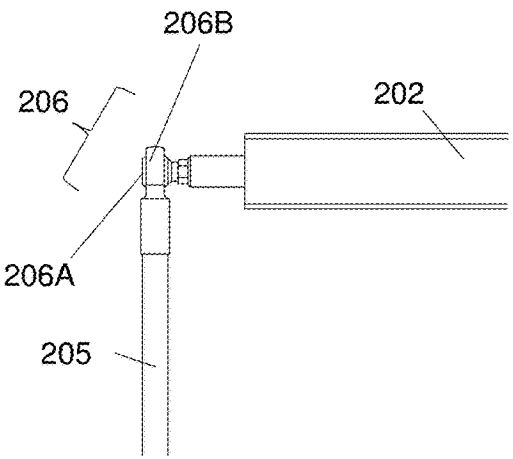
FIG. 4 illustrates in a close up view of one aspect of the swing trainer of the present disclosure being the swivel ball joint.

FIG. 4 illustrates more closely the ball swivel joint 206 that attaches the second vertical member 205 to the first horizontal member 202. The joint 206 comprises the ball end 206A which is at the free end of the first horizontal member 202 and the swivel joint 206B at a top end of the second vertical member 205. FIG. 5A illustrates the ball swivel joint 206 and how the second vertical member 205, with the ball swivel joint 206 at the proximal end, may swivel S at an angle A on the ball 206A attached at the free end of the first horizontal member 205. This ball swivel joint 206 allows the second vertical member 205 not only to rotate around the first horizontal member 205 but to swivel S in one direction or the other, away from or towards the plane P1 of the first vertical member based on where the ball (not shown) at the end of the second vertical member 205 is hit. This swivel range or angle A may be approximately at least 5°, or at least 10°, 15°, or at least 20°, or at least 25° in each direction as measured from the horizontal plane P2 of the first horizontal member ball connector 206A and first horizontal member 202 being horizontal with a ground or surface underneath. FIG. 5B illustrates this ball swivel joint 206 from another angle with first horizontal member 202, second vertical member 205, ball 206A, and swivel joint 206B which is an end having a circular opening to fit over the ball 206A allowing the second vertical member 205 to rotate or turn around the first horizontal member 202 and angle as described above either towards or away from the first vertical member.

Figure 6B:
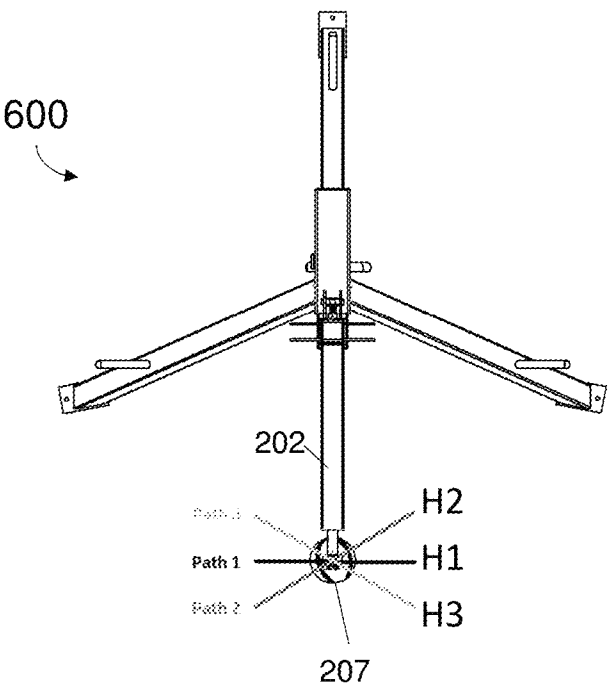
FIG. 6B illustrates path of the ball with respect to the first vertical member.
Figure 6A:
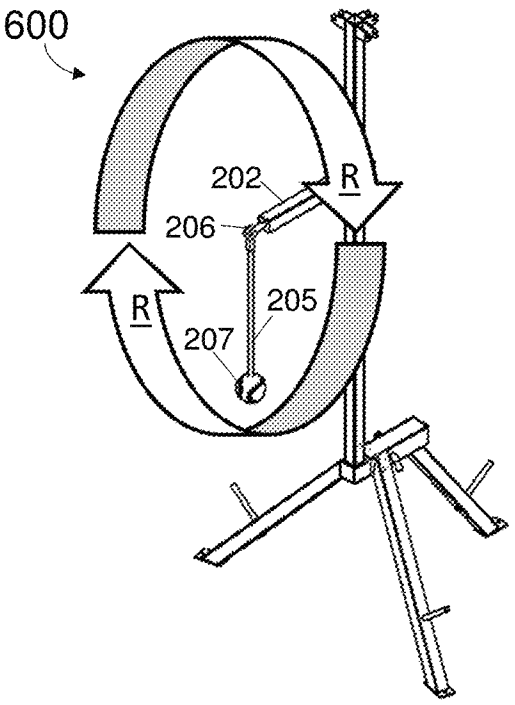
FIG. 6A shows rotation of the ball around the first horizontal member.

FIG. 6A illustrates how a sports ball on the swing trainer 600, which in this embodiment lacks the angular support member 212 shown in FIG. 2, may rotate around the first horizontal member 202. A hitter (not shown) would stand in front of the plane of the page and impact the sports ball 207, hanging from the end of the second vertical member 205, being attached to first horizontal member 202 with the ball swivel joint 206, with a bat, or other instrument such as a racquet, forcing the sports ball forward and up and around, thereby rotating R the sports ball 207 around the first horizontal member 202. FIG. 6B is a top down view of the hitting trainer 600. If a sports ball 207 is hit H1 in the center, the sports ball 207 will rotate around the first horizontal member 202 on Path 1 being a rotation with a plane that is about zero degrees different from the plane of the first vertical member whether the hitter is a right-handed hitter RH or a left-handed hitter LH, and they are standing on the left side or right side, respectively, of the second vertical member 205 of the swing trainer 600. If a right-handed hitter RH standing on the left side of the trainer 600 hits the sports ball 207 on the outside H2, then the ball 207 will rotate about the first horizontal member 202 on Path 2 being up to about twenty-five degrees away from the plane of the first vertical member. Conversely, if a left-handed hitter LH standing to the right of the trainer hits the sports ball 207 on the inside H2, the ball will also follow Path 2 around the first horizontal member. In a third example, if a right-handed hitter standing on the left side of the trainer hits a sports ball 207 on the inside H3, it will follow Path 3 rotating in a plane not more than about twenty five degrees towards the first vertical member 201.

Figure 8A:
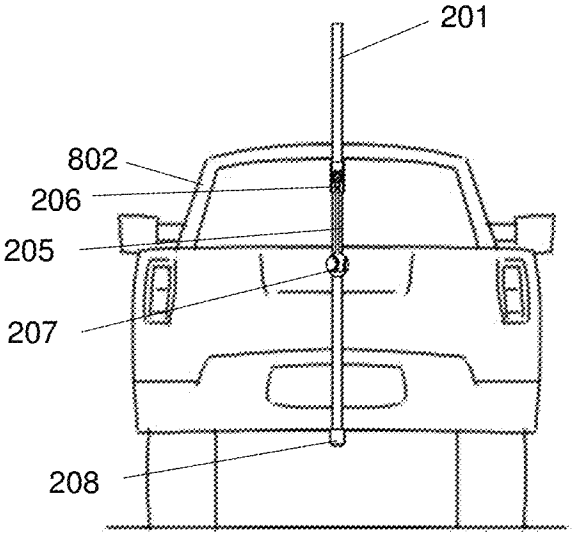
FIG. 8A illustrates the second embodiment of the swing trainer attached to a vehicle.
Figure 8B:
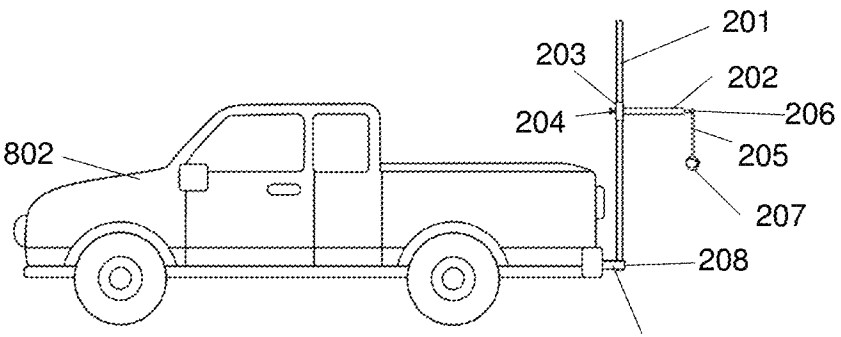
FIG. 8B illustrates another view of the second embodiment of the swing trainer attached to a vehicle.
Figure 7:
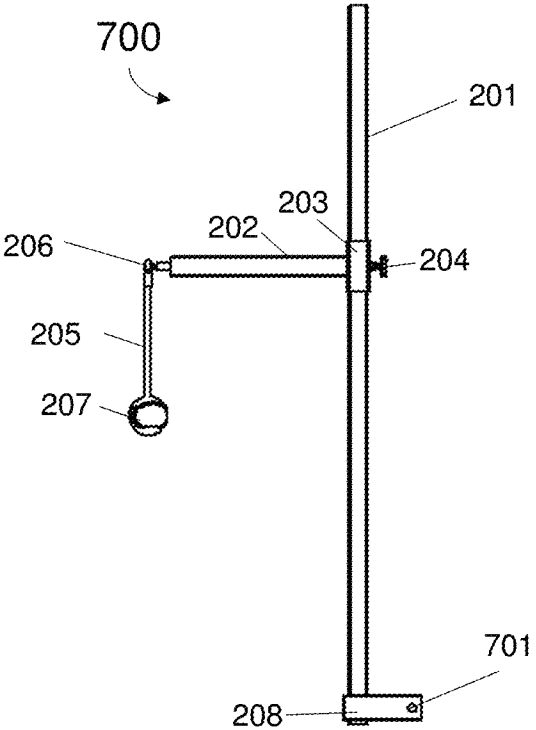
FIG. 7 illustrates a second embodiment of the swing trainer of the present disclosure.

FIG. 7 is a side view illustration of a second arrangement of the disclosed swing trainer 700. This embodiment includes the first vertical member 201, first horizontal member 202 with sleeve connector 203 and screw pin 204, second vertical member 205, swivel ball joint 206, the second horizontal member 208, and optionally a sports ball 207. As shown in FIGS. 8A and 8B, the second horizontal member 208, as noted above, is a rectangular member with hollow center having dimensions and design including a hitch pin 701 to fit and secure the second horizontal member 208 into a standard vehicle hitch receiver 801 of a vehicle 802 being a truck, car, or other motorized or non-motorized vehicle. The weight of the vehicle 802 balances the force from the ball rotating around the first horizontal member 202 thereby holding the device 700 stationary when the ball is hit allowing for rotation and swivel of the ball with respect to the first horizontal member 202.

Figure 9:
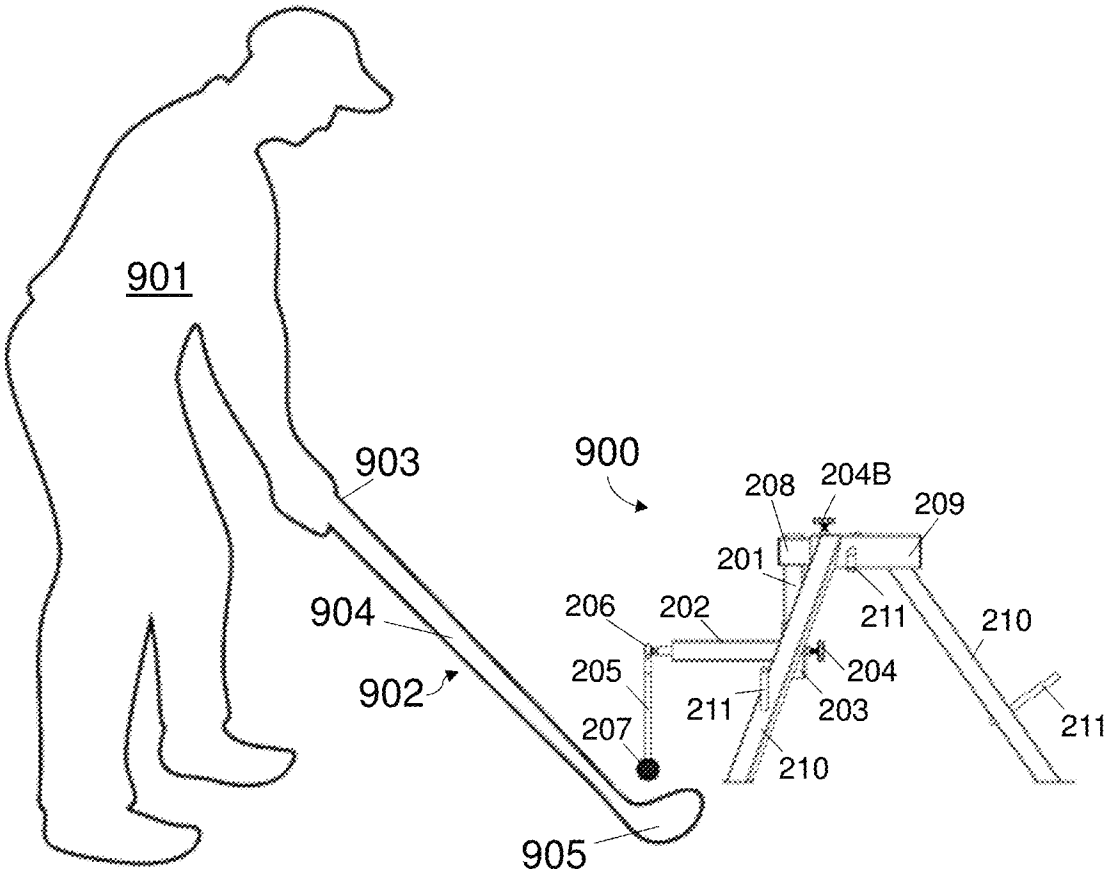
FIG. 9 illustrates a third embodiment of the present disclosure.

FIG. 9 illustrates another embodiment of the swing trainer device 900 designed for a golf player 901. The swing training device 900 designed for a golf player 901 includes many of the same members as the training device 200, 600 shown in FIGS. 2 and 6A, 6B. These include the first vertical member 201 and first horizontal member 202 connected with a sleeve 203 and screw pin 204 to vary height of the first horizontal member 202. The second vertical member 205 is connected to the first horizontal member 202 with the ball swivel joint 206 to allow for rotation and swivel of the sports ball 207, here being a golf ball, around the first horizontal member 202 as is described for and shown in FIGS. 6A and 6B. The second horizontal member 208 may be secured into the horizontal base member 209 with a screw 204B and/or pin 211. Legs 210, two in view here with a third being behind the device, support the horizontal base member 209 and second horizontal member and device 900 in an upright position. These legs 210 may be one part or at least two parts or more with portions being nested within each other and secured with pins 211 to provide height adjustment means. Other designs for support and height adjustment are contemplated as described above. The golf player 901 image is provided to show relative scale and approximate size of a swing training device 900 designed for a golf player 901. The training device 900 may stand about one foot tall, or fifteen inches tall, or eighteen inches tall, or twenty-one inches tall, or two feet tall, or two and a half feet tall, or three feet tall or more.

As is illustrated in FIG. 9, in use a golf player 901 will grip a club 902 with one or two hands at the handle end 903 of the club 902. The player 901 will draw the club 902 back and then swing the shaft 904 connected to the head 905 such that the head 905 contacts the sports ball 207 causing the sports ball 207 to rotate and optionally swivel around the first horizontal member 202 as described in FIGS. 6A and 6B giving feedback to the player as to where the head 905 contacted the sports ball 207 such that the player may adjust their swing accordingly.

Figure 10B:
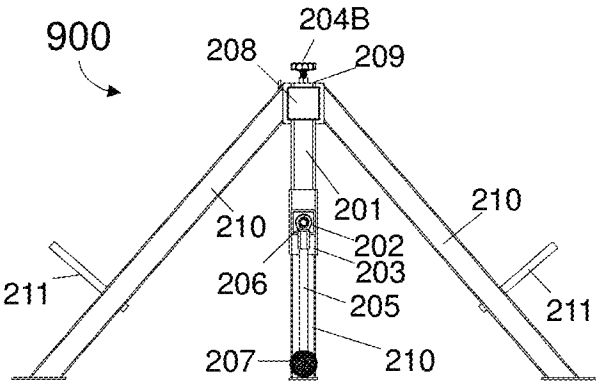
FIG. 10B illustrates a front view of the third embodiment of the present disclosure.
Figure 10A:
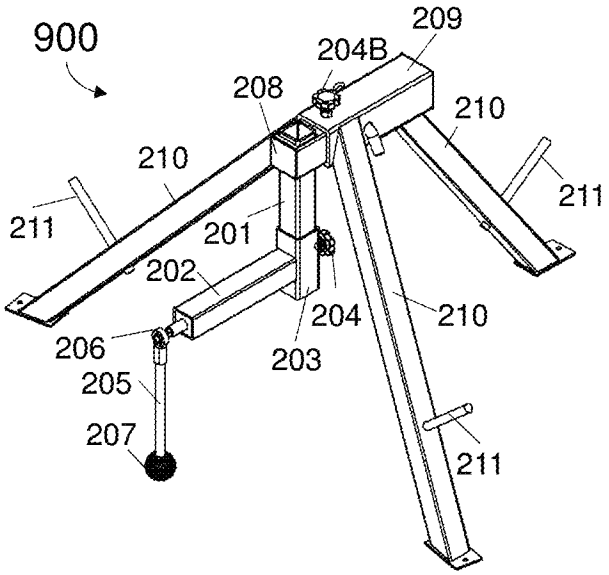
FIG. 10A illustrates a top perspective view of the third embodiment of the present disclosure.

FIGS. 10A and 10B show alternate views of the swing training device embodiment 900 designed for a golf player. FIG. 10A is a top perspective view and FIG. 10B is a front view of the swing trainer 900 with the first vertical member 201 and first horizontal member 202 connected with a sleeve 203 and screw pin 204 to vary height of the first horizontal member 202. The second vertical member 205 is connected to the first horizontal member 202 with the ball swivel joint 206 to allow for rotation and swivel of the sports ball 207 around the first horizontal member 202 as is described for and shown in FIGS. 6A and 6B. In addition to the first vertical member 201, first horizontal member 202, second vertical member 205, ball swivel joint 206, and sports ball 207, and other connections thereof 203, 204, being the main parts needed for the swing training device, the second horizontal member 208 may be secured into the horizontal base member 209 with a screw 204B and/or pin 211. Legs 210 support the horizontal base member 209 and second horizontal member and device 900 in an upright position.

EXAMPLES

Example 1

Figure 11B:
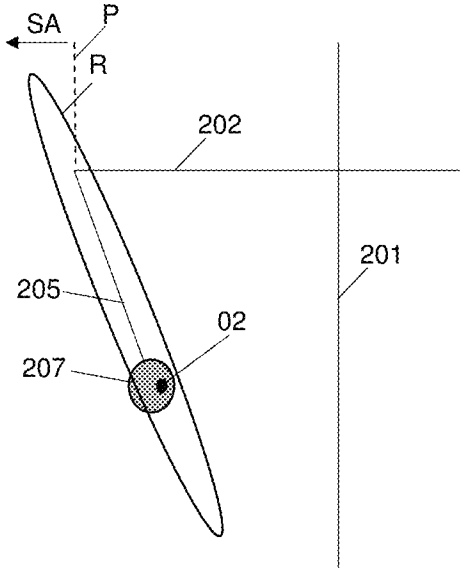
FIG. 11B illustrates a first alternate path of the ball around the first horizontal member.
Figure 11A:
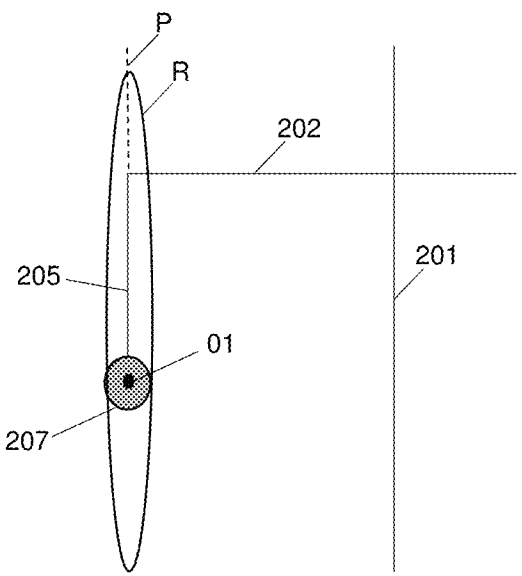
FIG. 11A illustrates the path of a ball based on a center hit.
Figure 11C:
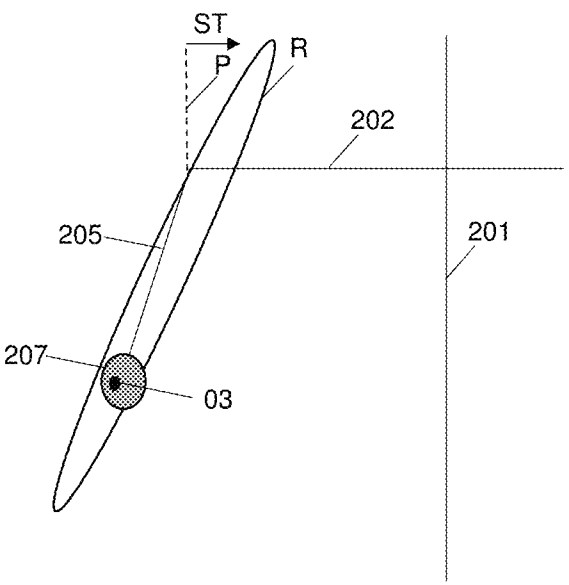
FIG. 11C illustrates a second alternate path of the ball around the first horizontal member.

FIGS. 11A, 11B, and 11C serve as example of the pattern of rotation of the ball and illustrate the rotation R and swivel S around the first horizontal member 202 from a front view when the ball is hit by a hitter who would be positioned in this case in front of the plane of the diagrams. Not all parts of the device are illustrated in these schematic diagrams but the basic version or embodiment with essential parts of the swing training device include the first vertical member 201, first horizontal member 202, ball swivel joint (not shown), second vertical member 205 and sports ball 207. In FIGS. 11A, 11B, and 11C in an example of a right-handed hitter, the hitter would stand to left of the second vertical member 205 which connects to the sports ball 207. As shown in FIG. 11A, if a sports ball 207 is hit, by a right-handed hitter in the center 01 it will rotate R or spin around the first horizontal member 202 in a plane P at approximately a zero angle from the plane of the first vertical member 201. As shown in FIG. 11B, if a right-handed hitter, standing to the left of the second vertical member 205 hits the sports ball on the outside 02 in reference to the hitter, in baseball terms 'around the baseball', the ball will rotate R at an angle off center or be swiveled away SA from the original plane P of the second vertical member at an angle that may be only a few degrees but about at least five degrees, or at least ten degrees, or at least fifteen degrees, or at least twenty degrees, or at least twenty five degrees. As shown in FIG. 11C, when the right-handed hitter is standing to the left of the second vertical member 205 hits the sports ball 207 on the inside 03 position, or in baseball turns in an 'inside outs swing', the ball rotates R around the first horizontal member 202 at an angle swiveling towards ST that may be only a few degrees but at least about five degrees, ten degrees, or at least fifteen degrees, or at least twenty degrees, or at least twenty-five degrees from the plane P of the first vertical member 201.

Example 2

In an example where you have a left-handed hitter, the hitter would position themselves to the right of the second vertical member 205 of FIGS. 11A, 11B, and 11C. As with the right-handed hitter and shown in FIG. 11A, if a sports ball 207 is hit in the center 01 by a left-handed hitter it will rotate R or spin around the first horizontal member 202 in a plane P at approximately a zero angle from the plane of the first vertical member 201. For the example shown in FIG. 11B, if the left-handed hitter, standing to the right of the second vertical member 205 hits the sports ball on his/her inside 02 in reference to the hitter, in baseball terms 'inside out swing', the sports ball will rotate R at an angle off center or be swiveled away SA from the original plane P of the second vertical member at an angle that may e only a few degrees, but could be at least about five degrees, or at least ten degrees, or at least fifteen degrees, or at least twenty degrees, or at least twenty five degrees. As shown in FIG. 11C, when a left-handed hitter is standing to the right of the second vertical member 205 hits the sports ball 207 on the outside 03 position, or in baseball turns in an 'around the baseball', the sports ball rotates R around the first horizontal member 202 at an angle swiveling towards ST that may be only a few degrees but about at least five degrees, or at least ten degrees, or at least fifteen degrees, or at least twenty degrees, or at least twenty-five degrees from the plane P of the first vertical member 201.

In prior art devices a sports ball may initially swivel at these angle SA, ST on a first rotation R but this angle will not be maintained through the second or a third or following rotations because the standard prior art joints or connectors do not allow for this swivel angle. The disclosed ball swivel joint of the present disclosure as described and shown above in FIGS. 2, 3A, 3B, 4, 5A, and 5B is engineering and designed to specification as disclosed to swivel at the angles specified herein allowing the ball to continue to rotate at the swivel angles SA and ST such that the hitter will recognize that the ball was hit in this case shown in FIG. 11B for a right-handed hitter on the outside 02 and be able to correct their swing. Similarly a golf player may use the disclosed swing training device as shown in FIG. 9, viewing the angle of rotation of the sports ball 207 around the first horizontal member 202 following hitting the ball with a club and adjust their swing. If the disclosed swing training device of FIG. 2 were altered to include a tennis or racquet ball and spacing or length of the first horizontal member 202 to accommodate a racquet, a tennis or racquet sport player may also benefit from using angle the ball rotates to improve swing. It is envisioned that the swing training device disclosed herein may be used for any sport or activity that involves hitting a ball with a device whether a bat, club, racquet, or others. Repetition of correct swing posture and positioning of body and limbs to achieve the desired outcome with the swing training device presented herein creates muscle memory such that a player is more likely to repeat said movement and their swing accuracy is thereby improved.

Although the present invention has been described with reference to the disclosed embodiments, numerous modifications and variations can be made and still the result will come within the scope of the invention. No limitation with respect to the specific embodiments disclosed herein is intended or should be inferred. Each apparatus and apparatus embodiment described herein has numerous equivalents.

What is claimed is:

1. A swing trainer, the trainer comprising:

a) a first vertical member, being rigid and columnar in form;

b) a first horizontal member having two ends, a first end connected to the first vertical member and a second end being a rounded end;

c) a second vertical member with a rigid upper portion and a flexible lower portion, the rigid upper portion connecting to a ball swivel joint, wherein the ball swivel joint fits onto the rounded end of the first horizontal member thereby allowing the second vertical member to rotate around the first horizontal member at an angle up to about twenty-five degrees towards and away from the first vertical member;

d) a ball connected to the flexible lower portion of the second vertical member;

e) a second horizontal member being rigid in form and having a first and second end, wherein the first end is connected to a bottom end of the first vertical member; and f) three rigid angled members attached to the second horizontal member.

2. The swing trainer of claim 1 further comprising a rigid angled member attached to the first vertical member.

3. The swing trainer of claim 1, wherein two of the three rigid angled members are attached to the second horizontal member near the first end and the third angled member is attached to the second horizontal member near the second end.

4. A swing trainer, the trainer comprising:

a) a first vertical member, being rigid and columnar in form;

b) a first horizontal member having two ends, a first end connected to the first vertical member and a second end being a rounded end;

c) a second vertical member with a rigid upper portion and a flexible lower portion, the rigid upper portion connecting to a ball swivel joint, wherein the ball swivel joint fits onto the rounded end of the first horizontal member thereby allowing the second vertical member to rotate around the first horizontal member at an angle up to about twenty-five degrees towards and away from the first vertical member;

d) a ball connected to the flexible lower portion of the second vertical member; and e) wherein the first horizontal member is connected to the first vertical member near a bottom end of the first vertical member.

5. A swing trainer, the trainer comprising:

a) a first vertical member being rigid and columnar in form;

b) a first horizontal member having a first and a second end, the first end connected to the first vertical member and the second end being a rounded ball-shaped end;

c) a second vertical member with a rigid upper portion and a flexible lower portion, the rigid upper portion connecting to a ball-swivel joint, wherein the ball-swivel joint fits onto the rounded second end of the first horizontal member thereby allowing the second vertical member to rotate around the rigid first horizontal member at an angle up to about twenty five degrees towards and away from the rigid first vertical member;

d) a rigid second horizontal member connected a bottom end of the first vertical member and having three angular members attached thereto two being connected on opposite sides of an end connecting to the first vertical member, and one being connected at an end opposite to the end connecting to the first vertical member; and e) a ball connected to the free end of the flexible lower portion of the second vertical member.

* * * * *